United States Patent [19]

Salle

[11] 4,085,955

[45] Apr. 25, 1978

[54] PEN SHAKING DEVICE

[76] Inventor: Donald A. Salle, 3313 Shasta Dr., San Mateo, Calif. 94403

[21] Appl. No.: 744,005

[22] Filed: Nov. 22, 1976

[51] Int. Cl.[2] ..... B01F 11/00; B08B 7/02

[52] U.S. Cl. ..... 366/212; 134/117; 134/140

[58] Field of Search ..... 134/117, 121, 137, 180, 134/157; 259/72, 91

[56] References Cited

U.S. PATENT DOCUMENTS

| | | | |
|---|---|---|---|
| 2,081,142 | 5/1937 | Branaman, Sr. | 134/157 X |
| 2,545,914 | 3/1951 | Boucher | 134/140 X |
| 3,198,502 | 8/1965 | Thompson | 259/72 X |
| 3,815,115 | 6/1974 | Inque | 259/72 X |
| 3,964,926 | 6/1976 | Westphal | 134/117 |
| 3,973,760 | 8/1976 | Browning et al. | 259/72 |

*Primary Examiner*—Robert L. Bleutge
*Attorney, Agent, or Firm*—Phillips, Moore, Weissenberger, Lempio & Majestic

[57] ABSTRACT

A desk top shaker for unclogging a pen having ink which clogs the pen point, including a housing having an opening, a casing supported on a shaft in the housing and receiving the pen through the opening to removably hold the pen, a motor in the housing for vibrating the shaft and hence, the pen, and a switch on the housing to turn on the motor. The casing is removable from the housing and is closed on the bottom to catch ink which is ejected when the motor is turned on to unclog the pen. An adaptor is connectable to the top of the casing to receive and hold pens of different sizes.

16 Claims, 2 Drawing Figures

PEN SHAKING DEVICE

BACKGROUND OF THE INVENTION

This invention relates to an apparatus for vibrating a member and, more particularly, to a desk top apparatus to clean a pen which has become clogged due to the drying or thickening of ink in the pen.

In the graphic printing art, use is made of lettering pens to record or print information on a recording medium such as paper. There are a number of these pens in commercial use including, for example, a Leroy pen made by the Keuffel and Esser Co., Morristown, N.J., a Rapidograph pen made by the Koh-I-Noor Co., Bloomsbury, N.J., and a Castell type pen shown in U.S. Pat. No. 3,418,058. These pens are fountain type pens having an ink reservoir which is tapered to a thin wall, small diameter tube forming the stylus for applying the ink to the paper. Such styli have precision points and very fine clearances to permit capillary flow of the ink from the reservoir to the points.

One problem with these pens is that due to the close fit of the various parts, and the high "solids" content of the drafting ink, the pen points tend to clog even during use and almost invariably if the pen is unused for a few hours. Therefore, these pens have a cleaning plunger in the reservoir, which includes a cleaning wire that extends into the ink passageway interconnecting the reservoir and the lettering point. The plunger and wire are free to move within the reservoir and passageway for unclogging the latter.

Typically, a draftsman unclogs the pen by holding it in his hand and shaking it to move the plunger and attached wire back and forth in the reservoir and ink passageway. However, the ink hardens or thickens to such a great degree that it requires the draftsman to shake the pen rapidly and for an extended period of time to unclog it. While electromechanical vibrating means are known to shake the pen and unclog it, there is no convenient and relatively inexpensive vibrating apparatus which can be used by a draftsman to quickly unclog the pen.

SUMMARY OF THE INVENTION

It is an object of the present invention to provide a novel apparatus to vibrate members such as a lettering pen.

It is another object of the present invention to provide apparatus for vibrating a clogged fountain pen, which apparatus conveniently sits on a desk top.

A further object of the present invention is to provide a relatively inexpensive apparatus for automatically unclogging a fountain pen from hardened or thickened ink.

A still further object of the present invention is to provide an apparatus which is adaptable to various sizes of fountain pens to vibrate and unclog them.

These and other objects of the present invention are obtained through the use of a desk top type apparatus including a housing having therein a casing for holding a fountain pen, a shaft having at one end a collar for releasably holding the casing, and a motor connected to the other end of the shaft to vibrate the shaft. Also, an adaptor can be fitted on the casing to hold releasably a pen which otherwise could not be held by the casing.

In operation, the pen is secured in the casing and a switch on the housing is closed to turn on the electric motor. The shaft and connected casing are then vibrated to shake rapidly the pen and cause a plunger therein to vibrate rapidly, thereby unclogging the pen. After a few seconds, the pen is unclogged and the motor can be turned off so that the pen can be removed from the casing.

DETAILED DESCRIPTION OF THE DRAWINGS

Figure 2:
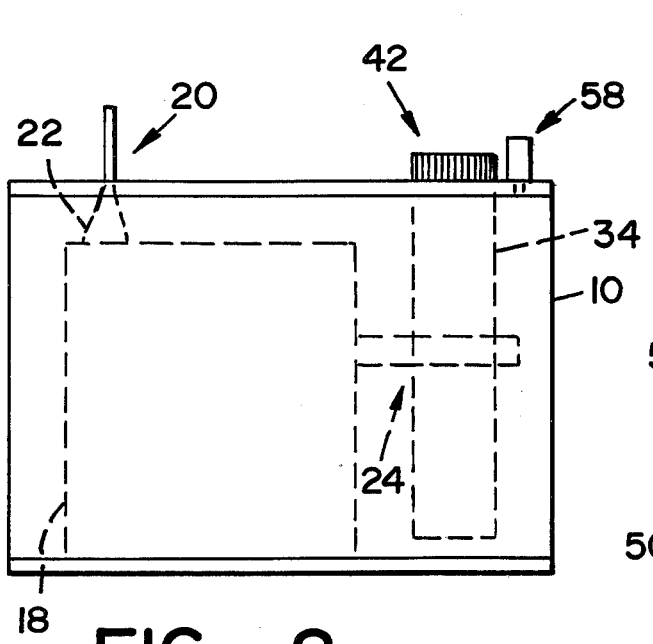
FIG. 2 is a front view of the present invention in its assembled state.
Figure 1:
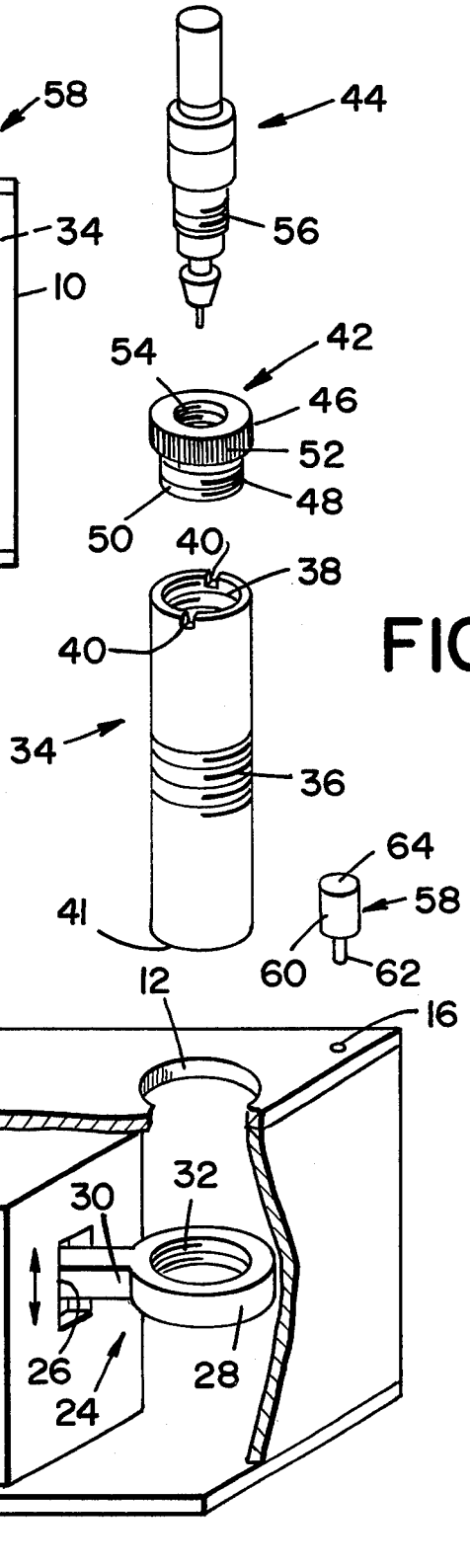
FIG. 1 is an exploded perspective view of the present invention.

With reference to FIGS. 1 and 2, the present invention includes a housing 10 having a circular opening 12, a rectangular opening 14, and another smaller, circular opening 16. As shown by the cut-away view of the housing in FIG. 1, an A.C. vibrator type motor 18 is supported inside the housing 10, with the connection to a standard A.C. wall outlet not being shown. One type of motor 18 is distributed by Shick, Inc., Lancaster, Pa., as part No. 11921 for use in an electric razor and made by the Krupps Company of West Germany. An on-off switch 20 is seated on the top of housing 10 and has an electrical coupling 22 extending through opening 14 to connect the switch 20 in circuit with the motor 18, as shown schematically in FIG. 2.

A shaft 24 has one end 26 connected to the motor 18, while a collar 28 is connected to the other end 30 of shaft 24 and has internal threads 32. A hollow, cylindrical casing 34 fits through opening 12 to the inside of the housing 10. Casing 34 includes external threads 36 at an intermediate part thereof, which mate with internal threads 32, whereby the shaft 24 supports the casing 34. Casing 34 is open at the top where it also has internal threads 38 and two oppositely disposed grooves 40. Casing 34 is closed at the bottom 41 to act as a catch basin for any fluid, such as ink, flowing in the casing.

An adaptor 42 can be connected to the casing 34 to hold a fountain pen 44 which might not have the correct size to be received by the threads 38. Adaptor 42 is hollow and includes a crown 46 and a cylindrical extension 48 having external threads 50 which mate with internal threads 38. Crown 46 includes ribs 52 to grip the adaptor 42 and screw it on the casing 34. The crown 46 also has internal threads 54 which are designed to receive external threads 56 on the outside of the barrel of pen 44, whereby the pen is releasably secured in the adaptor 42. If the pen 44 is of a sufficient size such that the threads 56 can mate with internal threads 38 in the casing 34, then the adaptor would not be required, and the pen can be connected directly to the casing. The pen 44 would be of the type already described having a plunger and wire (not shown) which are movable up and down in the pen to unclog it of dried or thickened ink. While the connection between pen 44 and adaptor 42 is shown preferably by means of threads, other means of connection could be used, such as a force fit between an unthreaded barrel of pen 44 and unthreaded crown 46.

The casing 34 is mounted to collar 28 from outside housing 10 by putting it through the opening 12 and collar 28 until the bottom of the threads 36 come in contact with the top of the threads 32. Then, a coin can be placed in the grooves 40 to rotate the casing 34 in a clockwise direction and thereby screw the threads 36 onto threads 32 until the top of the casing is substantially even with the top surface of housing 10, as indicated in FIG. 2. Then, if the adaptor 42 is required, it is screwed onto the casing 34 by mating the threads 50 with the threads 38 so that the bottom surface of crown 46 is flush with the top surface of the casing 34. The outside diameter of the crown 46 is small enough so as to not cause the adaptor 42 to touch the sides of opening 12. Thus, both the casing 34 and adaptor 42 can move vertically through opening 12 without interference from the sides of the latter.

A metal guard 58 has a larger diameter cylinder 60 sitting on the top surface of the housing 10 and a narrower diameter cylinder 62 which is force-fit into the opening 16. Alternatively, cylinder 62 and opening 16 can have mating threads to secure the guard 58 on the housing 10. Cylinder 60 extends upwards from the housing 10 such that its top surface 64 is higher than the top surface of the crown 46 when adaptor 42 is connected to the casing 34 as described. Without guard 58, should the housing 10 fall on the floor on its top surface, the adaptor 42 would come in contact with the floor to force movement of the casing 34 and hence cause the shaft 24 to bend. If the force is substantial, the shaft 24 may be bent out of shape and need replacing. The guard 58 acts as a "roll bar" to prevent the adaptor 42 from coming in contact with the floor, thereby preventing any substantial unwanted bending force on the shaft 24. While only one guard 58 is specifically shown, another guard such as guard 58 can be placed strategically on the top surface of housing 10 for greater protection; for example, in the area of housing 10 shown broken away in FIG. 1.

In operation, with the apparatus in its assembled state, as shown in FIG. 2, the pen 44 is threaded onto the adaptor 42. Then, the switch 20 is closed so that motor 18 is energized to vibrate shaft 24 in the vertical plane and thereby vibrate the pen 44. For example, motor 18 can cause the shaft 24 to move plus or minus ⅛ inch from its position at rest to shake rapidly the pen 44. Consequently, the plunger inside pen 44 will pulverize the hardened ink, causing such material to flow with the non-hardened ink by capillary action through the point of the pen and into the bottom of the casing 34. Usually the motor need only be energized a few seconds to unclog the pen 44. After this operation, the pen can be removed from the adaptor 42 and then the adaptor unscrewed from casing 34. Then, the casing 34 can be unscrewed from the collar 28 so as to clean its inside of the pulverized material and other liquid ink.

Below is a list of the approximate sizes of the various elements shown in FIG. 1, which make it very convenient as a desk top type vibrator for unclogging a fountain pen in the manner described:

| | | |
|---|---|---|
| housing 10 | 3 5/8" | (1) × 1 1/2"(w) × 2 1/2"(h) |
| collar 28 | 11/16" | inside diameter |
| | 14/16" | outside diameter |
| | 4/16" | length |
| casing 34 | 9/16" | outside diameter of threads 38 |
| | 11/16" | outside diameter of threads 36 |
| | 2 1/4" | length, with threads 38 extending 1/4 inch and approximately centered between the ends of the casing |
| crown 46 | 1/4" | length |
| cylinder 48 | 1/4" | length |
| opening 12 | 13/16" | diameter |

While the invention has been particularly shown and described with reference to a preferred embodiment thereof, it will be understood by those skilled in the art that the foregoing and other changes in form and details may be made therein without departing from the spirit and scope of the invention.

What is claimed is:

1. Apparatus for vibrating a member, comprising:

a) a housing;

b) a casing having means for removably holding said member;

c) a shaft, positioned within said housing, having at one end a collar holding said casing, said casing having means for removably connecting said casing within said collar from outside said housing; and d) a vibratory motor, connected to the other end of said shaft, for vibrating said shaft in a predetermined plane.

2. Apparatus according to claim 1 wherein said casing is a hollow cylinder and said means for removably holding includes first threads near the top of said cylinder.

3. Apparatus according to claim 2 wherein said collar has second internal threads and said means for removably connecting includes third threads mating with said second threads, said third threads being on the outside of and intermediate the ends of said cylinder.

4. Apparatus according to claim 3 wherein said means for removably holding includes an adaptor, threadably engaged with said first threads, for removably receiving a said member having a surface incapable of being held by said first threads.

5. Apparatus according to claim 4 wherein said vibratory motor is an electric motor.

6. A desk top shaker for unclogging a pen having ink which clogs the point of the pen, comprising:

a. a housing mountable on said desk and having a first opening at a top surface thereof;

b. a hollow casing, having a second opening at the top thereof in line with said first opening and being closed at the bottom thereof, for removably receiving said pen;

c. a shaft, within said housing, having a collar at one end removably holding said casing, said casing having means for removably connecting said casing to said collar from outside said housing; and d. means, including a vibratory electric motor inside said housing and connected to the other end of said shaft, for vibrating said shaft in a vertical plane.

7. A desk top shaker according to claim 6 wherein said hollow casing comprises:

a. first internal threads at the top of said casing to hold said pen; and b. second external threads intermediate the top and bottom of said casing to connect said casing to said collar, said second threads comprising said removably connecting means.

8. A desk top shaker according to claim 7 wherein said collar has third internal threads mating with said second external threads.

9. A desk top shaker according to claim 8 further comprising an adaptor, connected at the top of said casing, for removably holding a pen incapable of being held by said first threads.

10. A desk top shaker according to claim 9 wherein said adaptor comprises:

a. a hollow cylindrical member having fourth external threads mating with said first threads; and b. a crown connected on top of said cylindrical member and including means for gripping said adaptor to screw said fourth threads onto said first threads, said crown having fifth internal threads to receive said pen.

11. A desk top shaker according to claim 10 wherein said means for removably connecting further includes a pair of grooves on opposite sides of the top surface of said casing to facilitate screwing said second threads onto said third threads.

12. A desk top shaker according to claim 11 wherein said gripping means comprises ribs on the outer side of said crown.

13. A desk top shaker according to claim 12 wherein said vibrating means includes a switch, mounted externally on said housing and connected to said motor, to turn on said motor.

14. A desk top shaker according to claim 13 further comprising a guard mounted on top of said housing to prevent said casing and said adaptor from bending said shaft in the event said housing is dropped on said top surface thereof.

15. A desk top shaker according to claim 14 wherein said crown extends above said housing and said guard comprises a metal cylinder extending upwards beyond the top surface of said crown.

16. A desk top shaker according to claim 6 wherein said hollow casing includes threads at the top of said casing to hold said pen, and further comprising an adaptor, engageable with said threads, for removably holding a pen incapable of being held by said threads.

* * * * *